United States Patent [19]

Lashyro

[11] Patent Number: 4,989,779

[45] Date of Patent: Feb. 5, 1991

[54] BOTTOM LOCK ARRANGEMENT FOR CARTONS

[75] Inventor: Jeffrey A. Lashyro, Crosby, Minn.

[73] Assignee: Minnesota Automation, Inc., Crosby, Minn.

[21] Appl. No.: 398,138

[22] Filed: Aug. 23, 1989

[51] Int. Cl.[5] ..... B65D 5/48

[52] U.S. Cl. ..... 229/120.18; 206/140; 206/173; 206/188; 229/185

[58] Field of Search ..... 229/40, 120.18, 185; 206/140, 172, 173, 188

[56] References Cited

U.S. PATENT DOCUMENTS

| | | | |
|---|---|---|---|
| 2,593,135 | 4/1952 | Gilbert | 206/173 |
| 2,783,916 | 3/1957 | Hodapp | 206/173 |
| 2,917,202 | 12/1959 | Forrer | 229/120.18 |
| 3,140,797 | 7/1964 | Arneson | 206/173 |
| 3,288,326 | 11/1966 | Holmes | 206/173 |
| 3,351,263 | 11/1967 | Wood | 206/140 |
| 3,997,051 | 12/1976 | Graser et al. | 206/173 |

FOREIGN PATENT DOCUMENTS

| | | | |
|---|---|---|---|
| 203275 | 3/1966 | Sweden | 229/117.06 |

*Primary Examiner*—Gary E. Elkins
*Attorney, Agent, or Firm*—Anthony G. Eggink

[57] ABSTRACT

A bottom lock arrangement is provided for basket carriers having opposed end panels, opposed side walls and a floor structure. The basket carriers have a center wall disposed between and parallel the side walls to provide at least two side by side cells for the carrier. The bottom lock arrangement comprises at least one connector tab extending from the center wall, and the floor structure further comprises opposed first and second floor panels. The first panel is foldably connected to one side wall and the second panel is foldably connected to the opposite side wall. The first and second panels are sized to overlap one another and they further have aligned connector slots to receive the connector tab of the center wall. Center wall connector tab configurations and cooperating aligned connector and locking slot configurations in the first and second panels are provided to yield secure bottom locking arrangments. Methods for erecting and loading the basket carriers are further provided for the basket carrier structures having the bottom lock arrangements.

15 Claims, 5 Drawing Sheets

BOTTOM LOCK ARRANGEMENT FOR CARTONS

BACKGROUND OF THE INVENTION

This invention relates to article carriers and generally, to basket style carriers or cartons for bottles or other product containers. Particularly, this invention relates to bottom lock arrangements and methods for these basket style carriers.

Many different styles of bottle and can carrier structures are known in the prior art and used in the beverage industry to market beer and soft drink containers. Basket style carriers or cartons represent one of the most common types of carrier structures used in the beverage industry. These basket style carriers typically include opposed side and end walls and having partitions which define multiple cells. The latter basket carriers typically have six or eight such cells that are provided in side by side rows of three or four cells that are divided by a center wall. The basket carriers receive a filled beverage bottle, for example, in each cell and which are ultimately supported by the carrier's floor structure. The center wall is provided with a handle slot at its upper portion to permit easy lifting and carrying of the filled carrier by the consumer.

As known in the beverage industry, basket carriers are typically top loaded at the bottling facility. Thus, basket carriers typically require filled bottles to be inserted into the carrier's cells from the top. Thus, it is common practice for the carton manufacturer to glue or connect the basket carrier together so that when it is erected it is fully assembled and ready to receive bottles or other product containers. The basket carrier is structured by the manufacturer so that it can be knocked down or placed in a flat configuration when it is shipped.

Upon receiving the knocked down or flat basket carriers, the bottling facility erects the basket carriers and fills them with products such as beer or soft drink containers. Therefore, top loading basket carriers are common in the bottling industry.

Alternatively, and as taught in U.S. Pat. No. 4,802,324, issued Feb. 7, 1989, and assigned to Applicant's assignee of this application, cartoner assemblies and methods are known whereby the bottles, cans, or other product containers are loaded through the bottom of the basket carriers. These bottom loading style basket carriers provide various commercial advantages and which provide labor and machinery cost savings. The bottom loading basket carriers are manufactured and shipped to a bottling facility in a knocked down shipping configuration. In use, the bottom loaded basket carriers when erected with their bottom portions open are moved vertically over predetermined arrangements of bottles whereby each bottle is positioned in the individual cells of the basket carriers. Thereafter, the carrier's floor panel is closed and connected so that the bottles can be carried by the ultimate retail consumer.

In summary, the floor of the bottom loading basket carrier is not closed or sealed when it is shipped from the carton manufacturer. As mentioned above, this arrangement omits any preloading at a bottle manufacturer, and individual bottles are not required to be lifted from the carriers prior to filling the containers at the bottling facility.

Various prior art bottom loading basket carrier structures are known, and which consist of carrier structures that require the use of adhesives to assemble the carton structures or they have various floor locking systems to effect this configuration. Two such basket carrier structures are disclosed in U.S. Pat. Application, Ser. No. 354,339, and PCT Ser. No. 89/02332, and in U.S. Pat. Application, Ser. No. 354,338, and PCT Ser. No. 89/02331. The latter basket carrier structures are of the type that require adhesives to provide the assembled basket carrier structure. Various other floor locking structures have been proposed in the past, however, these carrier configurations have several disadvantages. First, various physical locking systems are configured so that they do not result in the required floor assembled strength. Also, the assembled cartons do not maintain their square structure after being filled and locked together because of paper board memory which results in a tendency to return the carrier structure to its flat collapsed configuration. This lack of carrier squareness is not desirable from a retail standpoint in the marketing of beverage products to retail customers.

Accordingly, it is an object of this invention to provide a bottom lock arrangement for basket carriers that are loaded through the bottom, and which provides a physical locking arrangement that overcomes the shortcomings of these prior art basket carrier structures. It is another object of this invention to provide such a bottom lock arrangement which provides structural strength to the floor of the carrier, and which provides locking members that are easily utilized during the carton assembly process, and which results in an erected carton configuration that maintains its square configuration. The bottom lock arrangements of this invention also provide bottom filled basket carrier structures which do not require the use of adhesives and which are usable with various styles of bottles or other product containers.

SUMMARY OF THE INVENTION

This invention provides a bottom lock arrangement for basket carriers having opposed end panels, opposed side walls and a floor. The basket carrier has a center wall disposed between and parallel to the side walls to provide at least two side by side cells for the carrier. The bottom lock arrangement comprises at least one connector tab extending downward from the center wall, and the floor further comprises opposed first and second floor panels. The first panel is foldably connected to one side wall, and the second panel is foldably connected to the other side wall. The first and second panels are sized to overlap one another and they further have aligned connector slots to receive the connector tab of the center wall.

The invention further provides connector tabs for the center wall which are V-shaped locking members and which cooperate with connector slots in the first and second floor panels that are trapezoidal and rectangular slot configurations respectively. Also provided are connector tab structures for the center wall which are generally rectilinear locking members and which cooperate with connector and locking slots in the first and second floor panels that are, respectively, pairs of trapezoidal slots and cooperating aligned trapezoidal slot configurations.

Further, this invention provides methods for erecting and loading the basket carriers having the bottom lock arrangements of this invention.

These and other benefits of this invention will become clear from the following description by reference to the drawings.

BRIEF DESCRIPTION OF THE DRAWINGS

FIG. 2(*a*) is an end view of another basket carrier structure having the bottom lock arrangement of this invention;

DESCRIPTION OF THE PREFERRED EMBODIMENT

Figure 1:
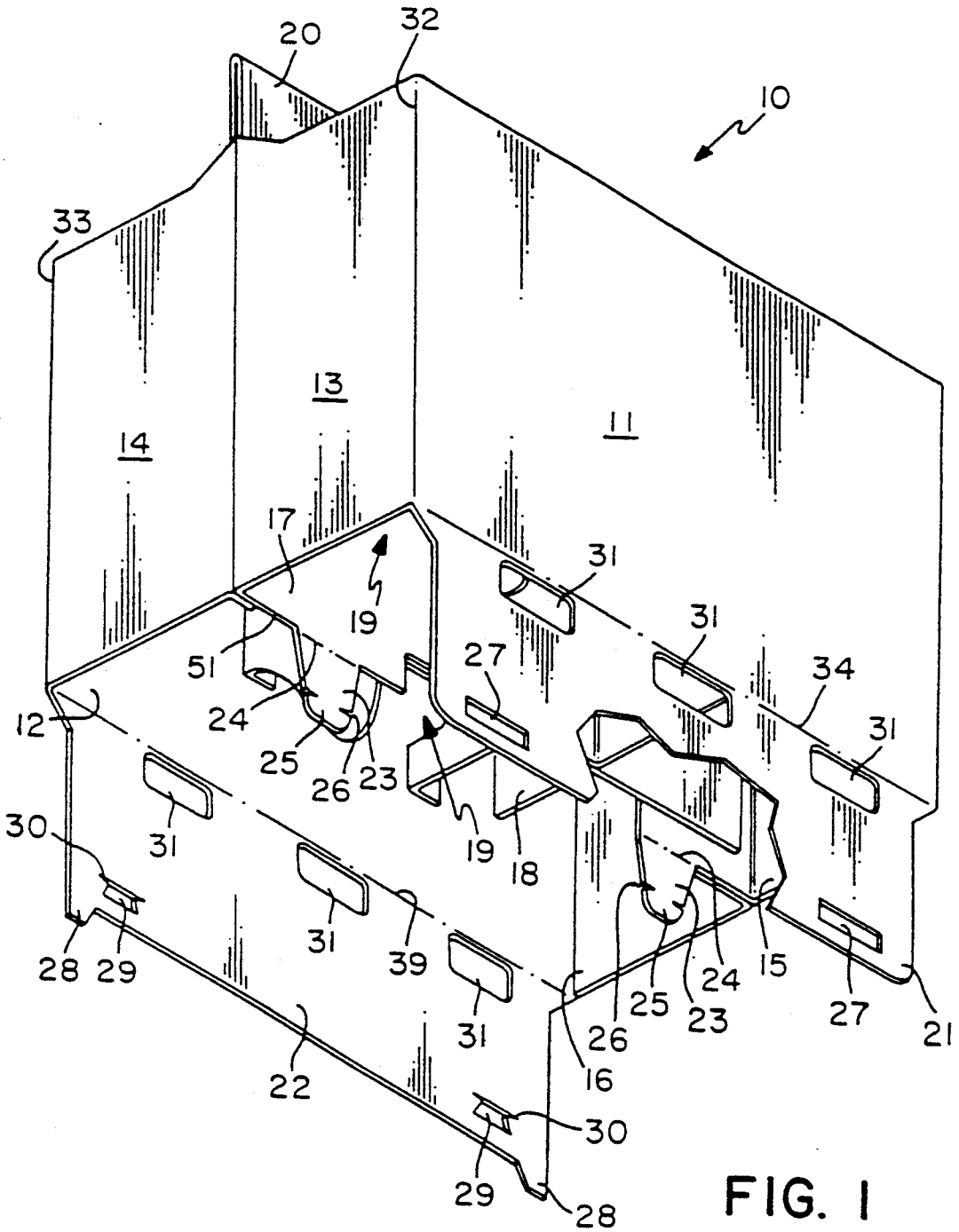
FIG. 1 is a perspective view showing a bottom loading basket carrier having the bottom lock arrangement of this invention, and further showing the carrier in an erected or set up configuration prior to being loaded with bottles.
Figure 2:
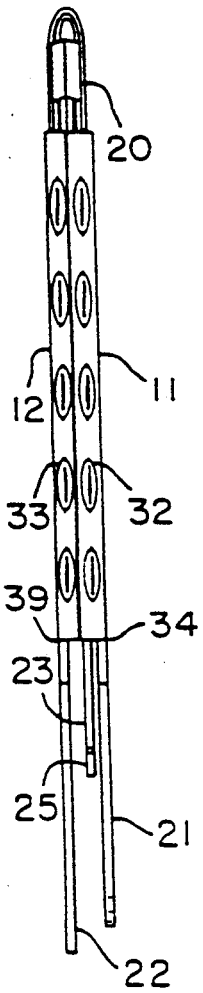
FIG. 2 is an end view of the basket carrier of FIG. 1 and showing the carrier in a flat and folded configuration.
Figure 2A:
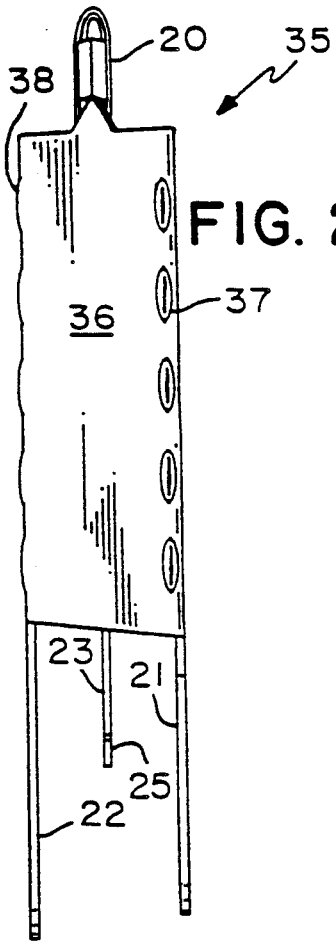

Referring to FIG. 1 of the drawings, a bottom loading basket carrier 10 is there shown having opposing side wall panels 11 and 12, opposing end wall panels and a floor structure. FIG. 2 shows an end view of the basket carrier structure of FIG. 1 which shows the carrier being in a flat and folded configuration and having score lines 32 and 33. This latter configuration is typically the manner in which basket carriers are shipped to a bottling facility, for example. Thus, cartons in the configuration as shown in FIG. 2 are shipped in the flat and folded manner to the bottling facility where the individual cartons are initially erected into a configuration as shown in FIG. 1. Particularly as shown in FIG. 1, the basket carrier 10 has its bottom floor panels 21 and 22 extending downwardly and in an open position so that products, such as bottles or cans, can be inserted into the carton or carrier structure from below. The floor panels 21 and 22 extend from the side wall panels 11 and 12 at score lines 34 and 39.

As further shown in FIG. 1, the bottom loading basket carrier 10 has a center wall 17 which extends from the center of one end wall structure 13, 14 to the center of the opposite end wall structure 15, 16 and which further has partition members 18 extending perpendicularly from the center wall 17 to the inside of the side wall panels 11 and 12 to thereby define cells 19 within which the bottles or other product containers are placed, stored and ultimately carried. A handle panel 20 extends upwardly from the center wall 17 to provide a means for the consumer to carry the basket carrier from a retail facility, for example.

Of importance to this invention are the connector tabs which extend downwardly from the center wall 17. As shown in FIG. 1, two such tabs 23 are provided, however, at least one such tab is required for purposes of this invention although any number can be utilized depending upon carrier size. For example, one such tab 23 having a longer width along fold line 24 may be utilized for the carton structure shown or for smaller cartons and three such tabs 23 may be utilized for longer cartons, such as eight packs. The connector tabs 23 are integrally connected to or extend from the center wall 17 and have a fold line 24. The fold line 24 is downward from the bottom edge 51 of the center wall 17 to accomodate the thicknesses of floor panels 21 and 22. As further shown in FIG. 2 the connector tab 23 is provided in the downwardly extending position, the purpose of which will be later described. Each connector tab 23 has a tab end portion 25 which is defined by opposed cut lines 26.

FIG. 2(*a*) shows the incorporation of the bottom lock arrangement of FIG. 1 in an alternate basket carrier structure 35. The drawing shows the end wall 36 of basket structure 35 as the basket carrier is being opened from a flat configuration. Essentially, unlike the carrier structure 10, the FIG. 2(*a*) structure has diagonally opposed working score lines 36 and 37 which define single end wall panels as opposed to the folding end wall panels 13, 14 and 15, 16 of FIG. 1. Thus, the bottom lock arrangement of this invention requires that the basket carrier structure have a center wall 17 and opposed floor panels. The remaining upper carrier structure, therefore, is not part of this invention, and other prior art upper carrier structures may also benefit by the teachings of this invention.

As further shown in FIG. 1, the floor panels 21 and 22 are provided with connector slots 27 and connector locking slots 29, respectively. The connector slots 27 and 29 are in alignment with the connector tabs 23 that extend from the center wall 17 when the carrier 10 is in the square and open configuration. As shown, the connector slot 27 is of a rectangular configuration, while the connector locking slots 29 are of a trapezoidal configuration and which further have cut lines 30 disposed along and extending from its shorter length. Further, the floor panel 22 is provided with floor panel tabs 28 that are disposed on the outside corners of the floor panel structure and which are positioned to straddle the connector tabs 23. For assembly purposes, compression slots 31 are provided in each floor panel 21 and 22 along their respective fold lines 34, 39 with their connecting side wall panels 11 and 12, respectively. The compression slots 31 are utilized in the carton erecting art to maintain carrier squareness during assembly.

Figure 6:
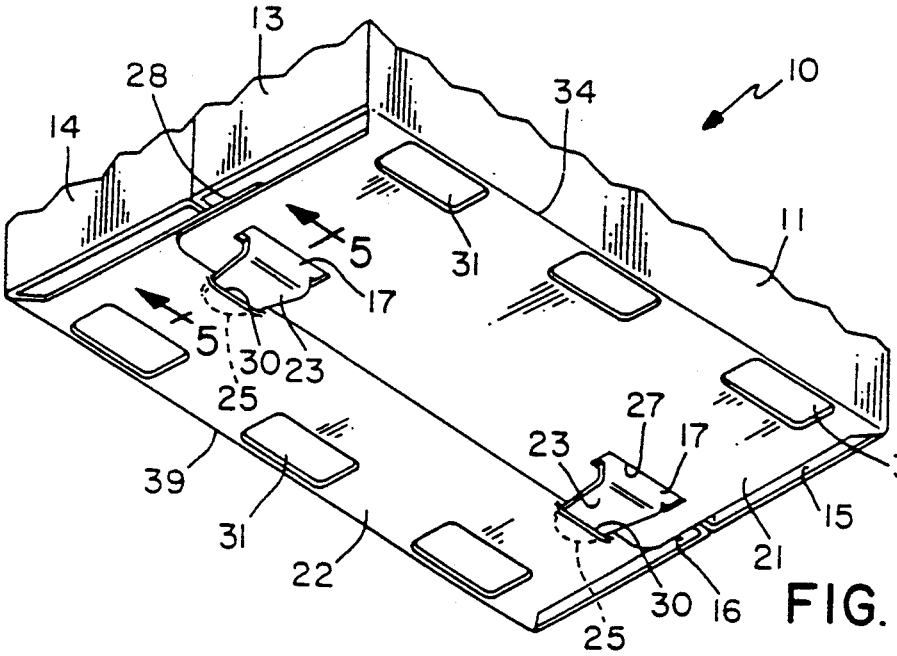
FIG. 6 is a perspective view of the basket carrier structure of FIG. 1 and showing its bottom floor in a locked configuration.

FIG. 6 is a perspective view of the basket carrier structure 10 and which shows its bottom floor structure in a locked configuration. Particularly, the floor panel 22 is shown folded with its floor panel tabs 28 straddling or touching the connector tabs 23 to ensure that side wall panel 12 of the basket carrier 10 remains square and parallel to the center wall 17. Further, the floor panel 21 is shown folded against the exterior surface of the opposed floor panel 22 and having the connector tabs 23 extending through the connector slots 27, to ensure that side wall panel 11 of the basket carrier 10 remains square or parallel to the center wall 17. Connector tabs 23 are inserted into the cut lines 30 of the connector locking slots 29 of floor panel 22. In this configuration, the bottles, or other product containers, are positioned and securely held by the floor structure comprising the folded and connected individual floor panels 21 and 22.

Figure 3:
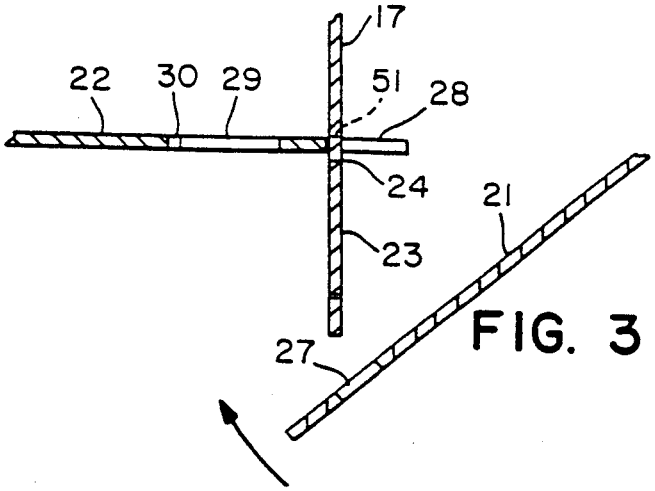
FIGS. 3, 4 and 5 show the bottom locking sequence steps for erecting the basket carrier structure of FIG. 1.
Figure 4:
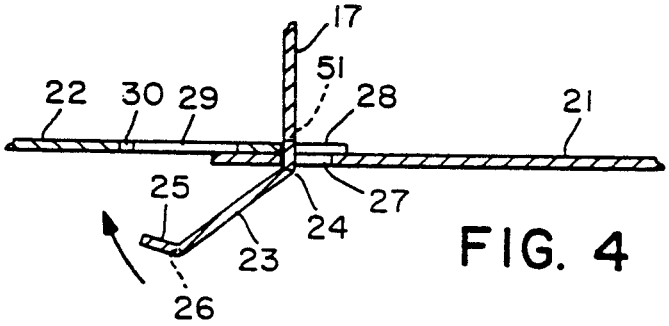
Figure 5:
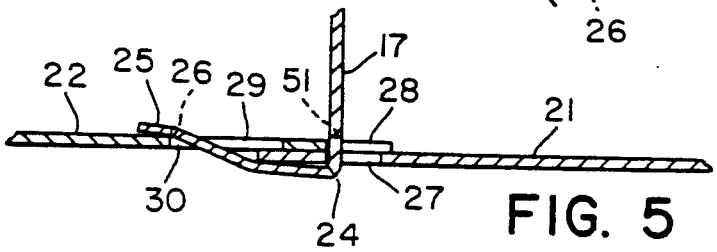

FIG. 5 is a cross sectional view taken along lines 5—5 of FIG. 6 and which shows the cooperation and connection between the connector tabs 23 and the connector slots in the floor panels 21 and 22. The method of erecting the basket carrier structure 10 from the configuration shown in FIG. 1 to that shown in FIG. 6 is shown in a step sequence in FIGS. 3, 4 and 5. Initially, as shown in FIG. 3, the floor panel 22 is shown folded and in communication with the bottom edge 51 of the center wall 17 and having the connector tab 23 extending adjacent the floor panel tabs 28. Thus, initially, the floor panel 22 is folded and guided toward the center wall 17 so that the exterior side base edges of connector tabs 23 are held between the slanted interior sides of the panel tabs 28 to provide a square carton configuration. This square configuration has the side wall 12 parallel to the center wall 17 and the end wall panels 14, 16 perpendicular to both of them. The V-shaped tabs 23 are particularly suited to yield this square configuration during this folding step. As further shown, the floor panel 21 is being folded towards the connector tab 23 whereby the connector tab is extended through the cooperating connector slots 27 to yield the configuration shown in FIG. 4. The rectangular slots 27 have a length equal to the base width of the tabs 23 so that the side wall 11 and end wall panels 13, 15 are in a square configuration with respect to the center wall 17. Thereafter, each connector tab 23 is inserted through the connector locking slot 29 whereby the tab end 25 is positioned in the cut line 30 of the connector locking slot 29. The locking slots 29 are shown to be trapezoidal apertures having opposed cut lines 30 disposed at their shorter lengths which cooperate with the cut lines 26 of tab ends 25 to lock the connector tabs 23 therein. As discussed, the final locked configuration of the basket carrier 10 is shown in FIGS. 5 and 6. As known in the art, various mechanical plows and guide structures are utilized in the locking section of the carton erecting machinery to hold and maneuver in a synchronized manner the cooperating connector tabs 23, floor panel 21 and floor panel 22 to effectuate the bottom locking sequence steps of FIGS. 3–5.

Figure 7:
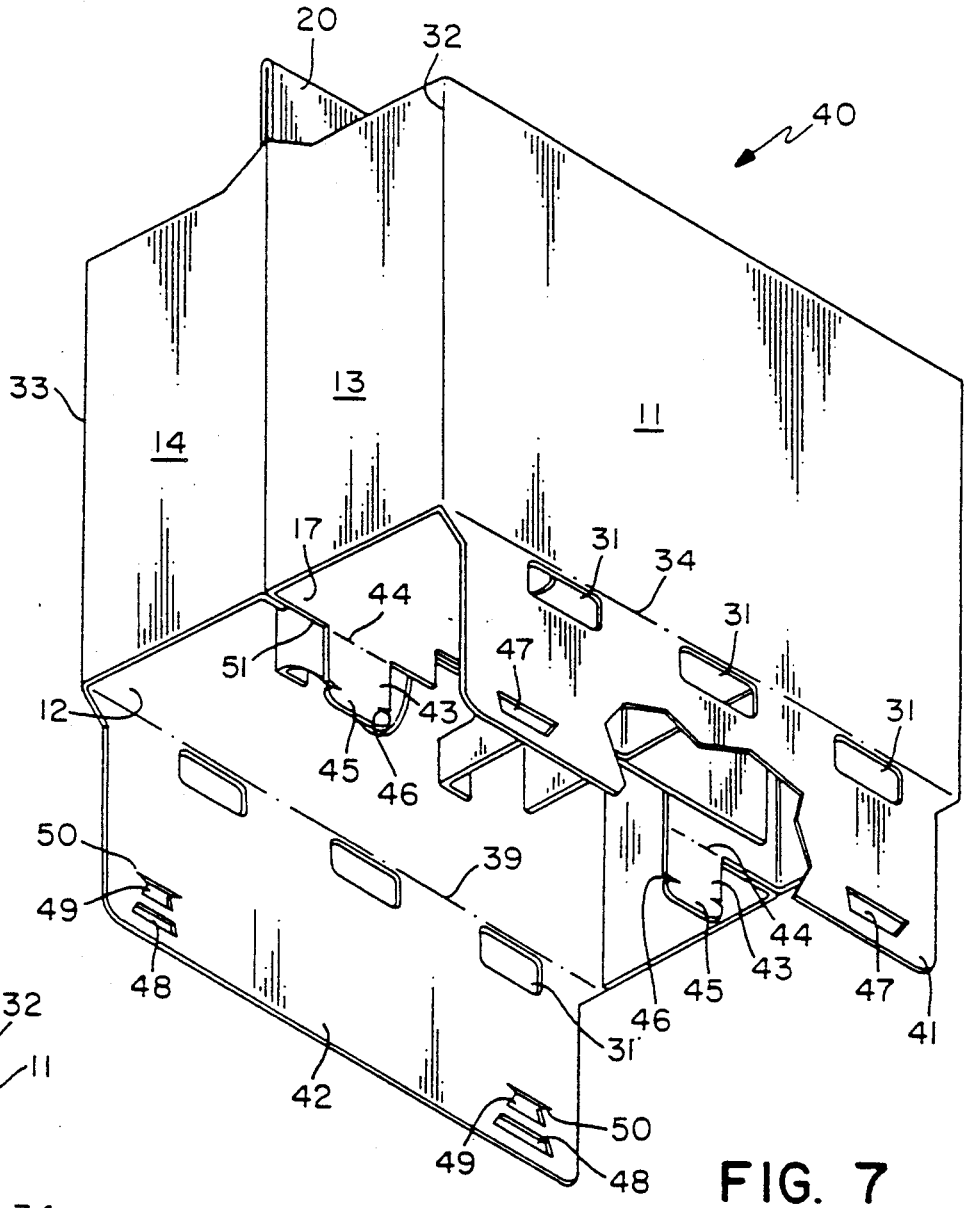
FIG. 7 is a perspective view showing another embodiment of the bottom loading basket carrier of this invention, and which further shows the carrier in an erected or set up configuration prior to being loading with bottles.
Figure 8:
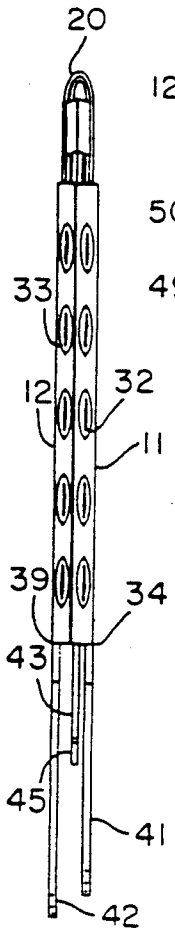
FIG. 8 is an end view of the basket carrier of FIG. 7 and showing the carrier in a flat and folded configuration.

FIG. 7 shows an alternate basket carrier configuration 40. This basket carrier or carton configuration has the same side wall panel members !1 and 12, end wall panels 13, 14, 15 and 16, score lines 32, 33 and center wall 17 as the embodiment of FIG. 1. Further, the connector tabs 43 are also shown extending from the center wall 17 and which are shown to have a fold lines 44 and tab ends 45 which are defined by opposed cut lines 46. Further, floor panels 41 and 42 are shown connected at the respective fold lines 34, 39 to the opposing side wall panels 11 and 12. The floor panel 41 is shown to have connector slots 47 positioned at its respective outside corners and adjacent and parallel to the bottom edge of the panel 41. The floor panel 42 is shown to have a pair of aligned connector slots 48 and 49. The connector slots 47, 48 and 49 are shown to be of a trapezoidal configuration which receive the connector tab structures 43. The connector locking slot 49 is further shown to have cut lines 50 extending from its smaller length so that the tab ends 43 can be locked therethrough at their respective cut lines 46.

Figure 12:
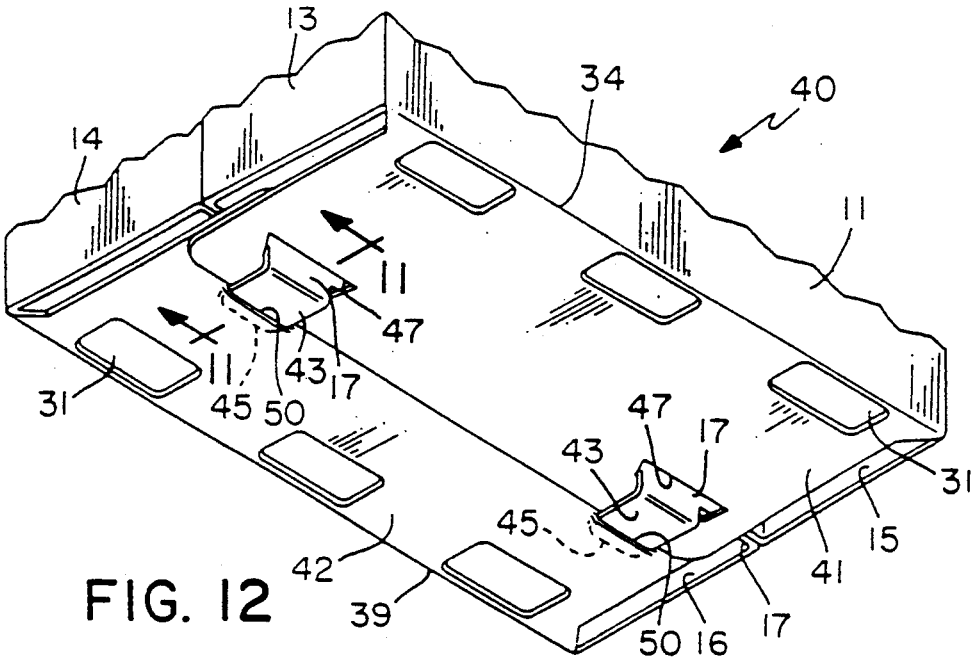
FIG. 12 is a perspective view of the basket carrier structure of FIG. 7 and showing its bottom floor in a locked configuration.

FIG. 12 shows a perspective view of the basket carrier structure 40 in an erected and bottom locked configuration. The connector tabs 43 are shown extending and folded through the respective floor panel slots and particularly are shown locked in the cut lines 50 of the connector locking slots 49 of floor panel 42.

Figure 9:
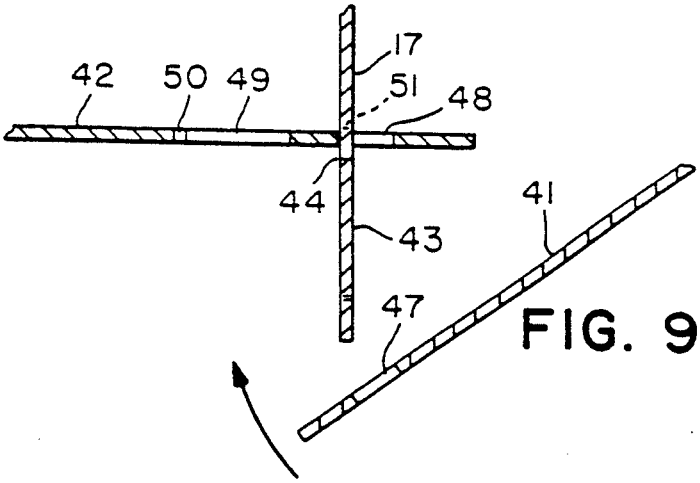
FIGS. 9, 10 and 11 show the bottom locking sequence steps for erecting the basket carrier structure of FIG. 7.
Figure 10:
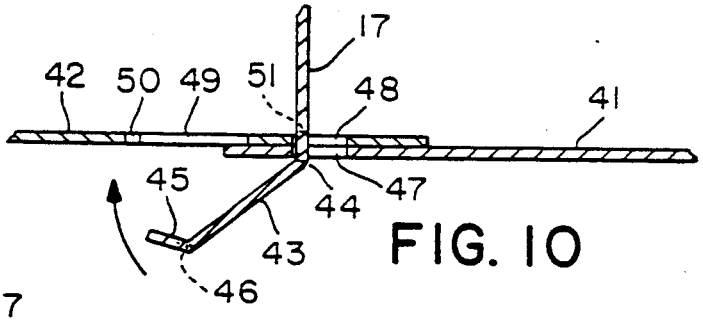
Figure 11:
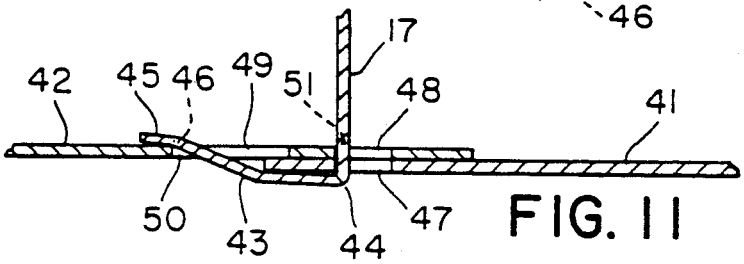

FIGS. 9, 10 and 11 show the bottom locking sequence steps for erecting the basket carrier structure 40. As shown in FIG. 9, initially the floor panel 42 is folded towards the downwardly extending connector tabs 43 until the panel structure 42 engages the bottom edge 51 of the center wall 17 at which point the connector tabs 43 extend through the connector slots 48. Next, the floor panel 41 is shown being folded towards the connector tabs 43 and into the configuration as shown in FIG. 10, whereby the connector tabs 43 are extended through the connector slots 47 of the floor panel 41. This configuration ensures that the side wall panels 11 and 12 of the basket carrier 40 remain square and parallel to the center wall 17. Finally, the tab end 45 of the connector tabs 43 are inserted through the connector locking slots 49 whereby the cut lines 46 of the connector tabs 43 ar positioned into the cut lines 50 of the connector locking slot 49 of floor panel 42 to thereby yield the erected and bottom locked carrier configuration.

As shown, the connector slots 48 are trapezoidal in configuration and have their respective shorter lengths being generally equal to the base width of the connector tabs 43. The trapezoidal connector slot 47 of panel 41 have a size generally equal to that of slot 48 of floor panel 42. As further shown, the fold line 44 is downward from the center wall bottom edge 51 a distance of approximately the total thickness of panels 41 and 42. The trapezoidal locking slots 49 of panel 42 have opposed cut lines 50 extending from opposed their shorter length to engage the cut lines 46 of tab ends 45. The distance or length of the connector tabs 43 from their fold lines 44 to their cut lines 50 is approximately the distance of the shorter length of the trapezoidal slot 48 to the shorter length of the trapezoidal locking slot 49.

Thus, this invention relates to bottom lock arrangements and methods for basket style carriers that are loaded through the bottom of the basket carrier structures. And, although the embodiments of FIGS. 1 and 7 show bottom lock arrangements for such cartons, the locking arrangements of this invention can be utilized with any bottom loading basket carrier so long as the carriers have center wall structures from which the connector tabs can be extended and the floor panels are structured in a cooperating manner as discussed above and as shown in the drawings.

As many changes are possible to the embodiments of this invention utilizing the teachings thereof, the description above and the accompanying drawings, should be viewed in the illustrative, and not in the limited sense.

That which is claimed is:

1. A bottom lock arrangement for a basket carrier having opposed end panels, opposed side walls and a floor structure, said basket carrier further having a center wall disposed parallel and between said side walls to provide at least two side by side cells for said carrier, said bottom lock arrangement comprising at least one connector tab extending from said center wall, said floor structure further comprising opposed first and second floor panels, said first panel foldably connected to one side wall and said second panel foldably connected to the opposite side wall, said first and second panels being sized to overlap one another, said first and second panels further having aligned connector slots to receive, position and lock said connector tab of said center wall and to maintain the floor structure in a secure configuration and to maintain the end and side walls in a square configuration.

2. The bottom lock arrangement of claim 1, wherein said connector tab has a base portion having a predetermined length and width and wherein said aligned connector slots have a length generally equal to or smaller than said connector tab base width.

3. The bottom lock arrangement of claim 1, wherein said first and second floor panels have compression slots disposed therein adjacent said respective folds with the side walls.

4. The bottom lock arrangement of claim 1, wherein said connector tab of said center wall is a V-shaped locking member and wherein said connector slots in said first and second floor panels are a trapezoidal slot and a rectangular slot respectively.

5. The bottom lock arrangement of claim 1, wherein said connector tab of said center wall is a generally rectilinear locking member and wherein said connector slots in said first and second floor panels are a pair of trapezoidal slots and an aligned trapezoidal slot respectively.

6. The bottom lock arrangement of claim 1, wherein each said connector slot of said floor panels receives said connector tab whereby the end and side walls are held square to the center wall.

7. The bottom lock arrangement of claim 4, wherein said V-shaped locking member has a predetermined length and a slotted locking end portion, and wherein said locking member has a base portion having a predetermined width, and wherein said trapeziodal slot has opposing, parallel and unequal lengths and having opposing cut lines extending from said smaller length and which is generally equal to said slotted locking end of said locking member.

8. The bottom lock arrangement of claim 5, wherein said rectilinear locking member has a predetermined length and a slotted locking end portion, and wherein said trapezoidal slot in said first floor panel has a shorter length generally equal to said locking member base portion width.

9. The bottom lock arrangement of claim 1, wherein said first floor panel is further comprised of a structure with outside corners each having a tap structure extending outwardly therefrom, said tab structure further having a slanted interior side to engage the outside edge of said connector tab to thereby position and hold said first panel in a configuration which maintains upper carrier squareness.

10. The bottom lock arrangement of claim 1, wherein said first and second floor panels have a predetermined thickness and wherein each said connector tab is comprised of a structure having a length generally equal to the sum of said first and second floor panel thickness, a fold line, an outer tab portion having a length equal to the distance spanning form said fold line through said connector slot in said second floor panel and having a locking end portion comprised of opposed slits for engaging each said connector slot in said second panel.

11. A bottom lock arrangement for cartons having side panels, end panels, a center wall divider with cell dividers attached thereto and having opposed and overlapping bottom flaps, said bottom lock arrangement comprising at least one male locking member extending downwardly from said center wall divider and at least one female locking slot in each said bottom flap in alignment and for communicative locking connection with each said male locking member.

12. The bottom lock arrangement of claim 11, wherein each said male locking member is comprised of a tapered tab having opposed cut lines at an end tip thereof and wherein each said female locking slot in said bottom flaps is comprised of a trapezoidal aperture having opposed cut lines.

13. The bottom lock arrangement of claim 11, wherein said bottom lock arrangement is comprised of two male locking members and two cooperating female locking slots.

14. The bottom lock arrangement of claim 11, wherein each said male locking member is comprised of a V-shaped locking member and wherein said female locking slots in said opposed bottom flaps are a trapezoidal slot and a rectangular slot respectively.

15. The bottom lock arrangement of claim 11, wherein each said male locking member is comprised of a generally rectilinear locking member and wherein said female locking slots in said opposed bottom flaps are a pair of trapezoidal slots and an aligned trapezoidal slot respectively.

* * * * *